US008985723B2

(12) United States Patent
Metcalfe et al.

(10) Patent No.: US 8,985,723 B2
(45) Date of Patent: Mar. 24, 2015

(54) SYSTEM AND METHOD OF COMPENSATING FOR DEFECTIVE INKJETS

(75) Inventors: David Jon Metcalfe, Marion, NY (US); Joel Chan, West Linn, OR (US)

(73) Assignee: Xerox Corporation, Norwalk, CT (US)

( * ) Notice: Subject to any disclaimer, the term of this patent is extended or adjusted under 35 U.S.C. 154(b) by 150 days.

(21) Appl. No.: 13/452,375

(22) Filed: Apr. 20, 2012

(65) Prior Publication Data

US 2013/0278658 A1 Oct. 24, 2013

(51) Int. Cl.
*B41J 29/38* (2006.01)
*B41J 2/21* (2006.01)

(52) U.S. Cl.
CPC ..... *B41J 2/2139* (2013.01)
USPC ..... 347/14; 347/9; 347/19

(58) Field of Classification Search
CPC ..... B41J 29/38
See application file for complete search history.

(56) References Cited

U.S. PATENT DOCUMENTS

| | | | | |
|---|---|---|---|---|
| 3,946,398 | A | 3/1976 | Kyser et al. | |
| 4,907,013 | A | 3/1990 | Hubbard et al. | |
| 4,963,882 | A | 10/1990 | Hickman | |
| 5,581,284 | A | 12/1996 | Hermanson | |
| 5,635,967 | A | 6/1997 | Klassen | |
| 5,640,183 | A | 6/1997 | Hackleman | |
| 6,161,919 | A | 12/2000 | Klassen | |
| 6,215,557 | B1 | 4/2001 | Owens | |
| 6,259,821 | B1 | 7/2001 | Branciforte et al. | |
| 6,575,549 | B1 | 6/2003 | Silverbrook | |
| 6,695,435 | B1 | 2/2004 | Cheng et al. | |
| 6,739,690 | B1 | 5/2004 | Darling | |
| 6,753,976 | B1 | 6/2004 | Torpey et al. | |
| 6,863,361 | B2 | 3/2005 | Barr et al. | |
| 6,868,180 | B2 | 3/2005 | Akahori et al. | |
| 6,880,907 | B2 | 4/2005 | Tsai | |
| 7,021,739 | B2 | 4/2006 | Burke et al. | |
| 7,075,677 | B1 | 7/2006 | Silverbrook | |
| 7,095,531 | B2 | 8/2006 | Mizes et al. | |
| 7,265,770 | B2 * | 9/2007 | Faken et al. | 347/171 |
| 7,318,637 | B2 | 1/2008 | Ishimoto et al. | |
| 7,338,144 | B2 | 3/2008 | Mantell et al. | |
| 7,484,830 | B2 | 2/2009 | Kim et al. | |
| 7,533,953 | B2 * | 5/2009 | Vladislav et al. | 347/14 |
| 7,604,316 | B2 * | 10/2009 | Terekhov et al. | 347/14 |
| 7,639,402 | B2 | 12/2009 | Vestjens et al. | |
| 7,731,342 | B2 | 6/2010 | Mantell | |
| 7,815,274 | B2 | 10/2010 | De Waal | |
| 7,854,490 | B2 | 12/2010 | Snyder | |
| 7,866,778 | B2 | 1/2011 | Silverbrook et al. | |
| 7,903,290 | B2 | 3/2011 | Faken et al. | |
| 8,001,893 | B2 | 8/2011 | McCoy et al. | |
| 8,042,899 | B2 | 10/2011 | Folkins et al. | |
| 2003/0053161 | A1 | 3/2003 | Li et al. | |

(Continued)

*Primary Examiner* — Manish S Shah
*Assistant Examiner* — Jeremy Delozier
(74) *Attorney, Agent, or Firm* — Maginot Moore & Beck LLP

(57) ABSTRACT

A method of compensating for a defective inkjet in an inkjet printer has been developed. A controller identifies pixels in binary image data corresponding to the defective inkjet. The controller identifies alternative pixel locations for non-defective inkjets to print ink drops proximate to the locations of the defective pixels. When an overlap parameter value identified between ink drops in alternative pixel locations and other ink drops around the alternative pixel locations exceeds a predetermined value, the controller changes the alternative pixel location for at least one ink drop to reduce overlap and improve image quality.

22 Claims, 5 Drawing Sheets

(56) References Cited

U.S. PATENT DOCUMENTS

| | | | | |
|---|---|---|---|---|
| 2003/0169442 | A1 | 9/2003 | Yokochi | |
| 2003/0218780 | A1 | 11/2003 | Braun et al. | |
| 2004/0196320 | A1 | 10/2004 | Walmsley et al. | |
| 2005/0105105 | A1 | 5/2005 | Vestjens et al. | |
| 2005/0110817 | A1 | 5/2005 | Burke et al. | |
| 2005/0116981 | A1 | 6/2005 | Faken et al. | |
| 2005/0146543 | A1 | 7/2005 | Smith et al. | |
| 2005/0285897 | A1 | 12/2005 | Temple | |
| 2006/0007497 | A1 | 1/2006 | Yokochi | |
| 2006/0125850 | A1 | 6/2006 | Kim et al. | |
| 2006/0279591 | A1 | 12/2006 | Lee | |
| 2006/0285131 | A1 | 12/2006 | Mantell et al. | |
| 2007/0070108 | A1* | 3/2007 | Mantell et al. | 347/19 |
| 2007/0070111 | A1* | 3/2007 | Vladislav | 347/19 |
| 2007/0273927 | A1 | 11/2007 | Misaizu et al. | |
| 2009/0315939 | A1* | 12/2009 | Mantell et al. | 347/19 |
| 2010/0245454 | A1 | 9/2010 | Ramakrishnan et al. | |
| 2012/0075370 | A1* | 3/2012 | Ramakrishnan et al. | 347/10 |

* cited by examiner

SYSTEM AND METHOD OF COMPENSATING FOR DEFECTIVE INKJETS

TECHNICAL FIELD

This disclosure relates generally to imaging devices that eject ink from inkjets onto an image receiving surface and, more particularly, to imaging devices that compensate for inkjets that are unable to eject ink to form a pixel onto the image receiving surface.

BACKGROUND

Drop on demand inkjet technology for producing printed media has been employed in commercial products such as printers, plotters, and facsimile machines. Generally, an inkjet image is formed by selectively ejecting ink drops from a plurality of drop generators or inkjets, which are arranged in one or more printheads, onto an image receiving surface. In a direct inkjet printer, the printheads eject ink drops directly onto the surface of a print medium such as a paper sheet or a continuous paper web. In an indirect inkjet printer, the printheads eject ink drops onto the surface of an intermediate image receiving member such as a rotating imaging drum or belt. During printing, the printheads and the image receiving surface move relative to one other and the inkjets eject ink drops at appropriate times to form an ink image on the image receiving surface. A controller in the printer generates electrical signals, also referred to as firing signals, at predetermined times to activate individual inkjets in the printer. The ink ejected from the inkjets can be liquid ink, such as aqueous, solvent, oil based, UV curable ink or the like, which is stored in containers installed in the printer. Alternatively, some inkjet printers use phase change inks that are loaded in a solid form and delivered to a melting device. The melting device heats and melts the phase change ink from the solid phase to a liquid that is supplied to a print head for printing as liquid drops onto the image receiving surface.

During the operational life of these imaging devices, inkjets in one or more printheads may become unable to eject ink in response to a firing signal. The defective condition of the inkjet may be temporary and the inkjet may return to operational status after one or more image printing cycles. In other cases, the inkjet may not be able to eject ink until a purge cycle is performed. A purge cycle can unclog inkjets and return the clogged inkjets to operation. Execution of a purge cycle, however, requires the imaging device to be taken out of its image generating mode. Thus, purge cycles affect the throughput rate of an imaging device and are typically performed during periods in which the imaging device is not generating images.

Existing methods enable an imaging device to generate images even though one or more inkjets in the imaging device are unable to eject ink. These methods cooperate with image rendering methods to control the generation of firing signals for inkjets in a printhead. Rendering refers to the processes that receive input image data values and then generate output image values. The output image values are used to generate firing signals for a printhead to cause the inkjets to eject ink onto the recording media. Once the output image values are generated, a defective inkjet compensation method uses information regarding defective inkjets detected in a printhead to identify the output image values that correspond to a defective inkjet in a printhead. The method then searches to find a neighboring or nearby output image value location that can be used to compensate for the defective inkjet. In one embodiment, a printer controller increases the amount of ink ejected near the defective inkjet by ejecting ink drops from other inkjets that are proximate to the defective inkjet. These compensating ink drops are directed to locations of the ink image that would otherwise be blank. Thus, an output image value can be stored at an empty image value location to enable an inkjet to eject a compensating ink drop at the location. By firing an otherwise unused nearby inkjet in this manner, the ejected ink density in the vicinity of the defective inkjet can approximate the ink mass that would have been ejected had the defective inkjet been able to eject the ink for a missing pixel.

Existing compensation methods for re-distributing the ink to be ejected by a defective inkjet to other neighboring or nearby inkjets decrease the perceived error due to the missing inkjet, but under some circumstances the existing compensation methods can increase the perceptibility of image defects generated by defective inkjets. For example, when the neighboring inkjets operate at an increased rate to compensate for the defective inkjet, then the neighboring inkjets can generate an uneven density of ink near the defective inkjet when compared to the surrounding region of the ink image. In some cases, the uneven ink density increases, rather than decreases, the perceptibility of the defective inkjet in the ink image. Consequently, defective inkjet compensation methods that enable more selective placement of the ink used to compensate for a defective inkjet would be beneficial.

SUMMARY

In one embodiment, a method of compensating for a defective inkjet in a printer has been developed. The method includes identifying a plurality of pixels in image data to be printed by an inoperable inkjet in a plurality of inkjets, identifying a first location in the image data for storage of a compensation pixel corresponding to one of the plurality of pixels to be printed by the inoperable inkjet, the first location being identified with reference to a predetermined sequence of pixel locations positioned about the one pixel to be printed by the inoperable inkjet, identifying an overlap parameter for ink to be ejected by the plurality of inkjets, storing the compensation pixel in a second location in the image data in response to the overlap parameter exceeding a predetermined threshold, the second location being a position in the predetermined sequence that is beyond the first location, and resetting the one pixel to be printed by the inoperable inkjet.

In another embodiment, an inkjet printer that compensates for a defective inkjet has been developed. The printer includes a plurality of operable inkjets and an inoperable inkjet, each one of the operable inkjets being configured to eject ink onto an image receiving surface, and a controller operatively connected to the plurality of inkjets and the inoperable inkjet. The controller is configured to identify a plurality of pixels in image data to be printed by the inoperable inkjet, identify a first location in the image data for storage of a compensation pixel corresponding to one of the plurality of pixels to be printed by the inoperable inkjet, the first location being identified with reference to a predetermined sequence of pixel locations positioned about the one pixel to be printed by the inoperable inkjet, identify an overlap parameter for ink to be ejected by the plurality of operable inkjets, store the compensation pixel in a second location in the image data in response to the overlap parameter exceeding a predetermined threshold, the second location being a position in the predetermined sequence that is beyond the first location, and reset the one pixel to be printed by the inoperable inkjet.

BRIEF DESCRIPTION OF THE DRAWINGS

The foregoing aspects and other features of a printer that enable compensation for defective inkjets are explained in the following description, taken in connection with the accompanying drawings.

DETAILED DESCRIPTION

Figure 1:
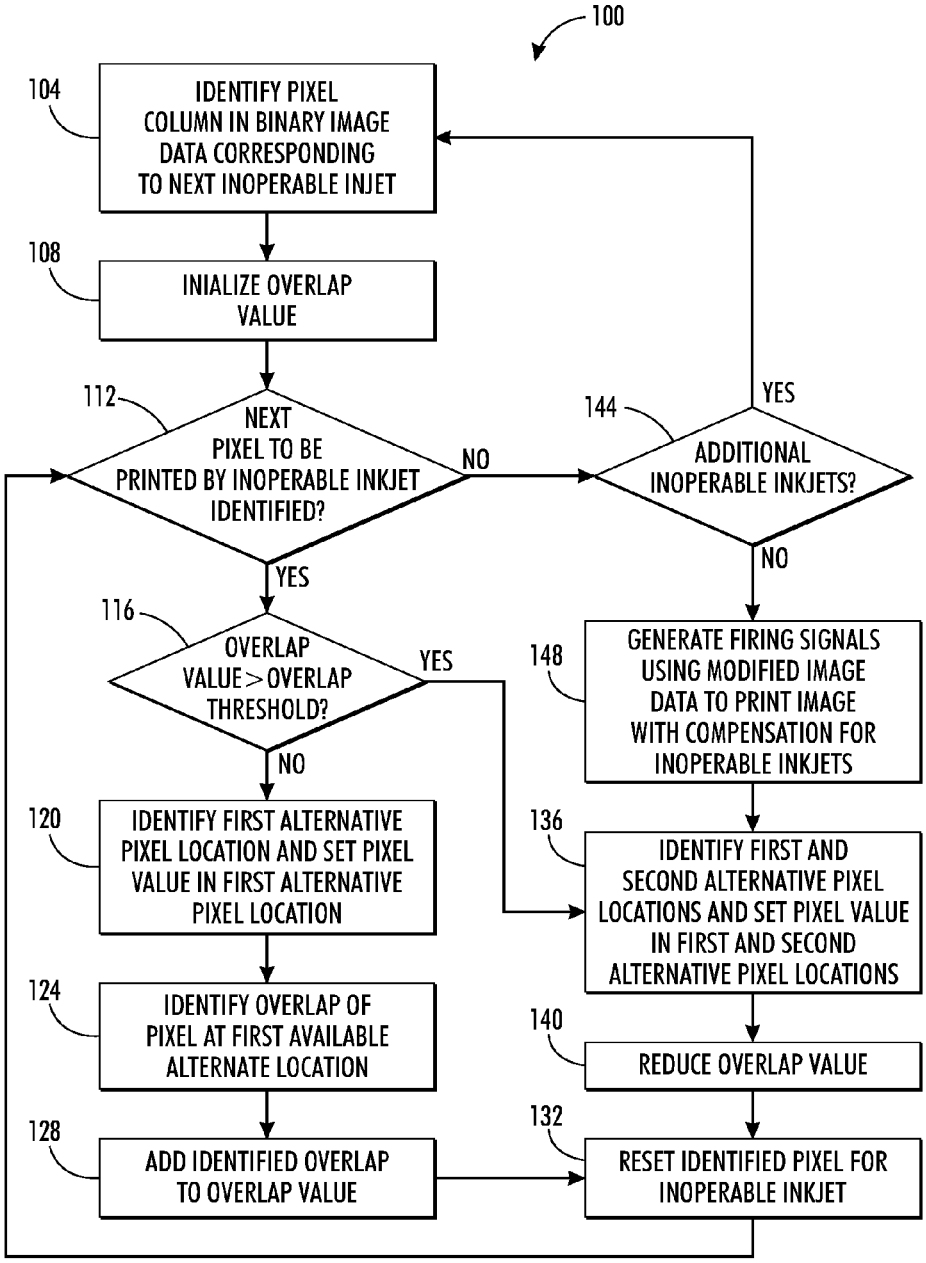
FIG. 1 is a block diagram of a process for operating inkjets in an inkjet printer to compensate for an inoperable inkjet.

For a general understanding of the environment for the system and method disclosed herein as well as the details for the system and method, reference is made to the drawings. In the drawings, like reference numerals have been used throughout to designate like elements. As used herein, the word "printer" encompasses any apparatus that produces images with colorants on media, such as digital copiers, bookmaking machines, facsimile machines, multi-function machines, etc.

As used herein, the term "inoperable inkjet" refers to a malfunctioning inkjet in a printer that does not eject ink drops, ejects ink drops only on an intermittent basis, or ejects ink drops onto an incorrect location of an image receiving member when the inkjet receives an electrical firing signal. A typical inkjet printer includes a plurality of inkjets in one or more printheads, and operational inkjets that are located near the inoperable inkjet can compensate for the inoperable inkjet to preserve the quality of printed images when an inkjet becomes inoperable.

As used herein, the term "pixel" refers to a single value in a two-dimensional arrangement of image data corresponding to an ink image that an inkjet printer forms on an image receiving surface. The locations of pixels in the image data correspond to locations of ink drops on the image receiving surface that form the ink image when multiple inkjets in the printer eject ink drops with reference to the image data. An "activated pixel" refers to a pixel in the image data wherein the printer ejects a drop of ink onto an image receiving surface location corresponding to the activated pixel. A "deactivated pixel" refers to a pixel in the image data having a value where the printer does not eject a drop of ink onto an image receiving surface location corresponding to the deactivated pixel. The term "binary image data" refers to image data formed as a two-dimensional arrangement of activated and deactivated pixels. Each pixel in the binary image data has one of two values indicating that the pixel is either activated or deactivated. An inkjet printer forms ink images by selectively ejecting ink drops corresponding to the activated pixels in the image data. A multicolor printer ejects ink drops of different ink color with reference to separate sets of binary image data for each of the different colors to form multicolor ink images.

As used herein, the term "overlap" refers to a situation where two or more ink drops each cover a single location on the image receiving surface. An amount of overlap refers to a size of one or more areas of the image receiving member that are covered by multiple ink drops, or to a number of ink drops that partially or completely overlap each other on a print medium at the end of an imaging process. The overlap typically occurs when nearby ink drops and merge together on the image receiving surface. The spreading can occur during a transfixing operation in an indirect inkjet printer or during a spreading operation for ink drops on a print medium in a direct inkjet printer. When two or more nearby ink drops spread and overlap on the print medium, the total area of the print medium that is covered with ink is less than if the same ink drops had been spread without overlapping. As used herein, the term "overlap parameter" refers to a numeric value that is generated with reference to the overlap between ink drops on the print medium. The overlap parameter can be identified prior to printing the image with reference to the arrangement of activated pixels in the image data.

In some configurations, a printer measures overlap with reference to separate colors. For example, in a multi-color printer, two cyan ink drops that spread into the same location on the image receiving surface overlap, but a cyan ink drop and a yellow ink drops that occupy the same location are not considered to overlap. A controller in a printer can estimate the overlap between ink drops with reference to image data of the printed image prior to forming printed ink image.

As used herein, the term "image density" refers to a number of pixels in either image data or an ink image that receive ink drops. In a high density region, a comparatively large portion of the pixels are activated and the corresponding region of the image receiving surface receives a correspondingly large number of ink drops. In a low density region, fewer pixels are activated and the corresponding region of the image receiving surface receives fewer ink drops.

Figure 5:
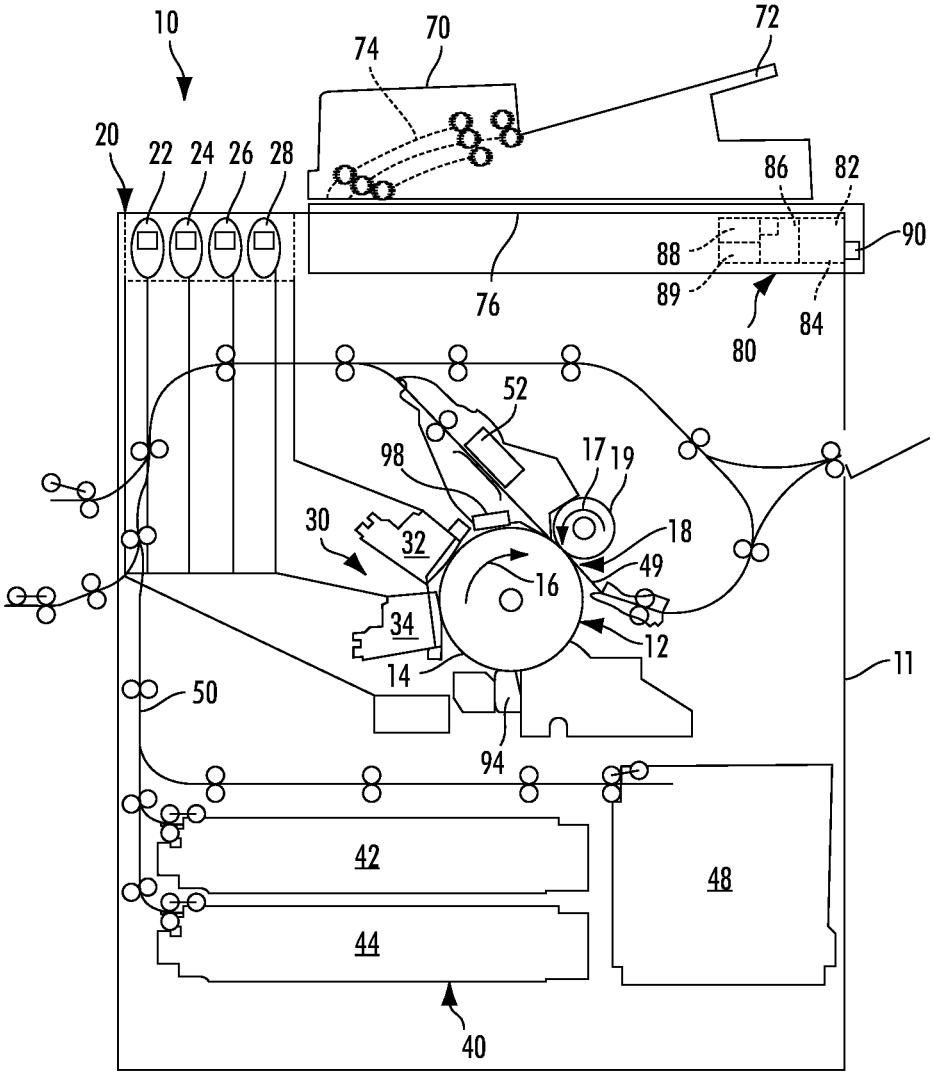
FIG. 5 PRIOR ART
FIG. 5 is a schematic view of a prior art inkjet printer.

FIG. 5 depicts an embodiment of a prior art printer 10 that can be configured to compensate for one or more inoperable inkjets. As illustrated, the printer 10 includes a frame 11 to which is mounted directly or indirectly all its operating subsystems and components, as described below. The phase change ink printer 10 includes an image receiving member 12 that is shown in the form of a rotatable imaging drum, but can equally be in the form of a supported endless belt. The imaging drum 12 has an image receiving surface 14, which provides a surface for formation of ink images. An actuator 94, such as a servo or electric motor, engages the image receiving member 12 and is configured to rotate the image receiving member in direction 16. A transfix roller 19 rotatable in the direction 17 loads against the surface 14 of drum 12 to form a transfix nip 18 within which ink images formed on the surface 14 are transfixed onto a heated print medium 49.

The phase change ink printer 10 also includes a phase change ink delivery subsystem 20 that has multiple sources of different color phase change inks in solid form. Since the phase change ink printer 10 is a multicolor printer, the ink delivery subsystem 20 includes four (4) sources 22, 24, 26, 28, representing four (4) different colors CMYK (cyan, magenta, yellow, and black) of phase change inks. The phase change ink delivery subsystem also includes a melting and control apparatus (not shown) for melting or phase changing the solid form of the phase change ink into a liquid form. Each of the ink sources 22, 24, 26, and 28 includes a reservoir used to supply the melted ink to the printhead assemblies 32 and 34. In the example of FIG. 5, both of the printhead assemblies 32 and 34 receive the melted CMYK ink from the ink sources 22-28. In another embodiment, the printhead assemblies 32 and 34 are each configured to print a subset of the CMYK ink colors.

The phase change ink printer 10 includes a substrate supply and handling subsystem 40. The substrate supply and handling subsystem 40, for example, includes sheet or substrate supply sources 42, 44, 48, of which supply source 48, for example, is a high capacity paper supply or feeder for storing and supplying image receiving substrates in the form of a cut sheet print medium 49. The phase change ink printer 10 as shown also includes an original document feeder 70 that has a document holding tray 72, document sheet feeding and retrieval devices 74, and a document exposure and scanning subsystem 76. A media transport path 50 extracts print media, such as individually cut media sheets, from the substrate supply and handling system 40 and moves the print media in a process direction P. The media transport path 50 passes the print medium 49 through a substrate heater or pre-heater assembly 52, which heats the print medium 49 prior to transfixing an ink image to the print medium 49 in the transfix nip 18.

Media sources 42, 44, 48 provide image receiving substrates that pass through media transport path 50 to arrive at transfix nip 18 formed between the image receiving member 12 and transfix roller 19 in timed registration with the ink image formed on the image receiving surface 14. As the ink image and media travel through the nip, the ink image is transferred from the surface 14 and fixedly fused to the print medium 49 within the transfix nip 18. In a duplexed configuration, the media transport path 50 passes the print medium 49 through the transfix nip 18 a second time for transfixing of a second ink image to a second side of the print medium 49.

Operation and control of the various subsystems, components and functions of the printer 10 are performed with the aid of a controller or electronic subsystem (ESS) 80. The ESS or controller 80, for example, is a self-contained, dedicated mini-computer having a central processor unit (CPU) 82 with a digital memory 84, and a display or user interface (UI) 86. The ESS or controller 80, for example, includes a sensor input and control circuit 88 as well as an ink drop placement and control circuit 89. In one embodiment, the ink drop placement control circuit 89 is implemented as a field programmable gate array (FPGA). In addition, the CPU 82 reads, captures, prepares and manages the image data flow associated with print jobs received from image input sources, such as the scanning system 76, or an online or a work station connection 90. As such, the ESS or controller 80 is the main multi-tasking processor for operating and controlling all of the other printer subsystems and functions.

The controller 80 can be implemented with general or specialized programmable processors that execute programmed instructions, for example, printhead operation. The instructions and data required to perform the programmed functions are stored in the memory 84 that is associated with the processors or controllers. The processors, their memories, and interface circuitry configure the printer 10 to form ink images, and, more particularly, to control the operation of inkjets in the printhead modules 32 and 34 to compensate for inoperable inkjets. These components are provided on a printed circuit card or provided as a circuit in an application specific integrated circuit (ASIC). Each of the circuits can be implemented with a separate processor or multiple circuits are implemented on the same processor. In alternative configurations, the circuits are implemented with discrete components or circuits provided in very large scale integration (VLSI) circuits. Also, the circuits described herein can be implemented with a combination of processors, FPGAs, ASICs, or discrete components.

In operation, the printer 10 ejects a plurality of ink drops from inkjets in the printhead assemblies 32 and 34 onto the surface 14 of the image receiving member 12. The controller 80 generates electrical firing signals to operate individual inkjets in one or both of the printhead assemblies 32 and 34. In the multi-color printer 10, the controller 80 processes digital image data corresponding to one or more printed pages in a print job, and the controller 80 generates two dimensional bit maps for each color of ink in the image, such as the CMYK colors. Each bit map includes a two dimensional arrangement of pixels corresponding to locations on the image receiving member 12. Each pixel has one of two values indicating if the pixel is either activated or deactivated. The controller 80 generates a firing signal to activate an inkjet and eject a drop of ink onto the image receiving member 12 for the activated pixels, but does not generate a firing signal for the deactivated pixels. The combined bit maps for each of the colors of ink in the printer 10 generate multicolor or monochrome images that are subsequently transfixed to the print medium 49. The controller 80 generates the bit maps with selected activated pixel locations to enable the printer 10 to produce multi-color images, half-toned images, dithered images, and the like.

During a printing operation, one or more of the inkjets in the printhead assemblies 32 and 34 may become inoperable. An inoperable inkjet may eject ink drops on an intermittent basis, eject ink drops onto an incorrect location on the image receiving surface 14, or entirely fail to eject ink drops. In the printer 10, an optical sensor 98 generates image data corresponding to the ink drops that are printed on the image receiving surface 14 after formation of the ink images and prior to the imaging drum 12 rotating through the nip 18 to transfix the ink images. In one embodiment, the optical sensor 98 includes a linear array of individual optical detectors that detect light reflected from the image receiving surface. The individual optical detectors each detect an area of the image receiving member corresponding to one pixel on the surface of the image receiving member in a cross-process direction, which is perpendicular to the process direction P. The optical sensor 98 generates digital data, referred to as reflectance data, corresponding to the light reflected from the image receiving surface. The controller 80 is configured to identify inoperable inkjets in the printhead assemblies 32 and 34 with reference to the reflectance values detected on the imaging receiving surface 14 and the predetermined image data of the printed ink images. In an alternative embodiment, an optical sensor detects defects in ink images after the ink images have been formed on the print medium 49. In another alternative embodiment, the inoperable inkjets are identified with sensors located in the printhead assemblies. In response to identifying an inoperable inkjet, the controller 80 ceases generation of firing signals for the inoperable inkjet, and generates firing signals for other inkjets that are proximate the inoperable inkjet in the printer to compensate for the inoperable inkjet.

The printer 10 is an illustrative embodiment of a printer that compensates for inoperable inkjets using the processes described herein, but the processes described herein can compensate for inoperable inkjets in alternative inkjet printer configurations. For example, while the printer 10 depicted in FIG. 5 is configured to eject drops of a phase change ink, alternative printer configurations that form ink images using different ink types including aqueous ink, solvent based ink, UV curable ink, and the like can be operated using the processes described herein. Additionally, while printer 10 is an indirect printer, printers that eject ink drops directly onto a print medium can be operated using the processes described herein.

FIG. 1 depicts a process 100 for operation of inkjets in a printer to compensate for an inoperable inkjet after the inoperable inkjet is identified. In the discussion below, a reference to the process performing a function or action refers to a controller executing programmed instructions stored in a memory to operate one or more components of the printer to perform the function or action. Process 100 is described in conjunction with the printer 10 in FIG. 1 for illustrative purposes.

Figure 2A:
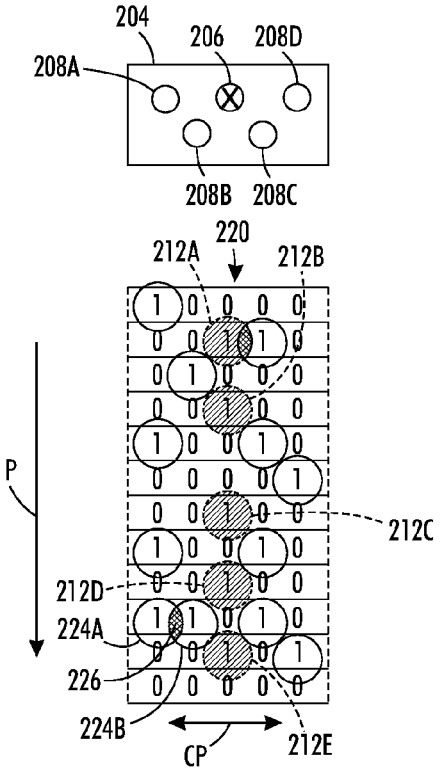
FIG. 2A is a schematic diagram of a printhead with an inoperable inkjet and an exemplary view of missing ink drops in a printed image.

Process 100 begins by identifying a column of image data corresponding to an identified inoperable inkjet (block 104). As used herein, a "column" of image data refers to an arrangement of pixels extending in the process direction P. In the printer 10, a single inkjet in one of the printhead assemblies 32 or 34 ejects drops onto activated pixels in the column as the image receiving surface 14 rotates in direction 16. The controller 80 controls the timing of firing signals generated for the inkjet so that ink drops land on the activated pixels in each column. When an inkjet is inoperable, the controller 80 does not generate firing signals and the pixels in the column corresponding to the inoperable inkjet do not receive ink drops. FIG. 2A depicts a simplified view of a printhead 204 with an inoperable inkjet 206 and neighboring operable inkjets 208A-208D. FIG. 2A depicts an array of binary image data, which are arranged in columns parallel to the process direction P, and in rows parallel to the cross-process direction CP. As described above, the image data are binary image data, and each pixel of image data takes one of two values. In FIG. 2A, a value of "0" indicates that the pixel is deactivated, and a value of "1" indicates that the pixel is activated. A column of pixels 220 corresponding to the inoperable inkjet 206 includes a plurality of activated pixels 212A-212E that include the "1" value, indicating that the inkjet 206 should print an ink drop onto the specified pixel locations. In process 100, the controller 80 identifies the column 220 as corresponding to the inoperable inkjet 206. In the printer 10, the controller 80 stores the binary image data in the memory 84, and the controller 80 selectively changes the values of pixels stored in the memory during process 100.

Figure 4A:
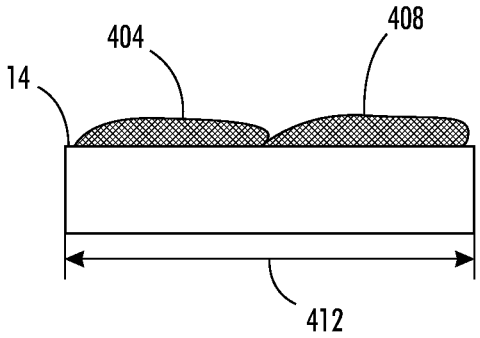
FIG. 4A is a profile view of two non-overlapping ink drops on an image receiving surface.
Figure 4B:
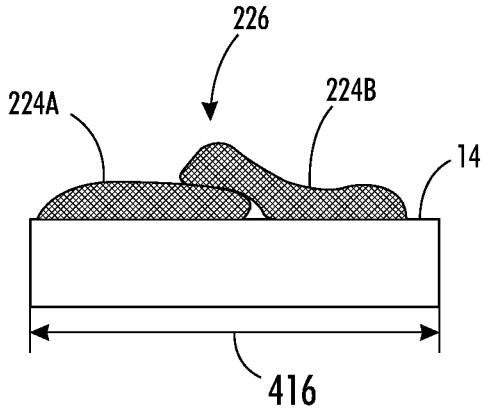
FIG. 4B is a profile view of two overlapping ink drops on an image receiving surface.

Process 100 continues by initializing an overlap parameter value for the column of pixels corresponding to the inoperable inkjet (block 108). The overlap parameter value that is initialized during the processing of block 108 references a measured degree of overlap between the alternative pixels that are activated to compensate for the ink drops that are not printed by the inoperable inkjet. As used herein, the term overlap refers to an amount of ink in neighboring activated pixels that merges together when the neighboring pixels are printed. For example, in FIG. 2A, the binary image data are arranged into adjoining pixels that are typically represented as adjoining squares. The physical ink drops printed on the image receiving member 12, however, do not perfectly conform to the square shape. Ink drops that are printed into nearby pixel locations can partially cover each other when ejected onto the image receiving member 12. For example, FIG. 2A depicts partially overlapping ink drops in pixel locations 224A and 224B, which overlap in a region 226. FIG. 4B depicts a profile view of the overlapping region 226 between the ink drops 224A and 224B on the image receiving surface 14. FIG. 4A, by contrast, depicts two non-overlapping ink drops 404 and 408. During the transfixing operation, overlapping or nearby ink drops expand and merge together when the ink drops are transferred to the print medium 49 in the nip 18. The pressure and heat generated in the nip 18 flattens and expands the ink drops beyond the borders of an individual pixel. The overlap between ink drops enables the printer 10 to print images with solid areas that are fully covered with ink.

Process 100 proceeds along the identified column of image data until identifying an activated pixel that should be printed by the inoperable inkjet (block 112). In one embodiment, process 100 progressively identifies pixels beginning with the first pixel of column 220 in the process direction P and progressing in the process direction P until the end of the column in the binary image data. For example, in FIG. 2A process 100 identifies activated pixels 212A, 212B, 212C, 212D, and 212E, in order. In another embodiment, process 100 begins with the final pixel in the column 220 and proceeds in the direction opposite the process direction P.

Process 100 compensates for the next identified pixel from the inoperable inkjet based on a comparison of the overlap parameter value to a predetermined overlap threshold (block 116). Calculation of the overlap parameter value is described in more detail below. If the overlap parameter value is less than the predetermined threshold, then process 100 identifies the first alternative pixel location available to compensate for the identified missing pixel, and sets the pixel value to activate the first alternative pixel location (block 120). The first alternative pixel location is also referred to as a "compensation pixel" because another inkjet in the printer prints an ink drop into the alternative pixel location to compensate for the missing inkjet. In one embodiment, the first alternative pixel location is identified with reference to a predetermined search pattern in a region of pixels surrounding the pixel from the inoperable inkjet.

Figure 3A:
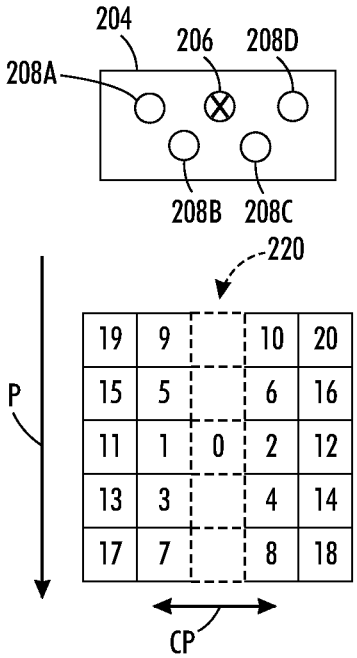
FIG. 3A is a schematic diagram of the printhead of FIG. 2A and an exemplary search pattern for identifying an alternative pixel location to compensate for the inoperable inkjet in the printhead.
Figure 3B:
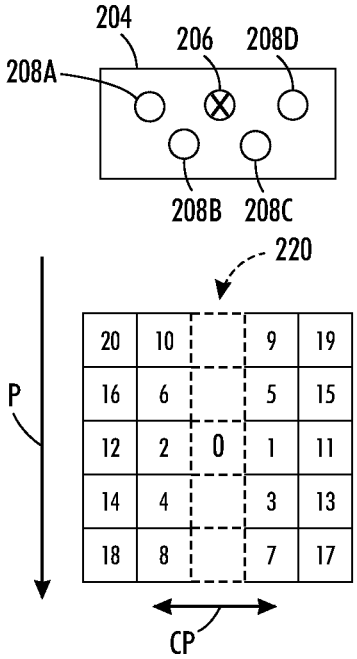
FIG. 3B is a schematic diagram of the printhead of FIG. 2A and another exemplary search pattern for identifying an alternative pixel location to compensate for the inoperable inkjet in the printhead.

FIG. 3A and FIG. 3B depict two exemplary search patterns that the controller 80 uses to find an alternative pixel location. In FIG. 3A, the next identified activated pixel from the inoperable inkjet 206 is identified at location 0 along the pixel column 220. The numbered pixels surrounding pixel 0 correspond to an ordered arrangement of potential alternative locations where another one of the inkjets 208A-208D ejects an ink drop to compensate for pixel 0. The controller 80 searches the alternative pixel locations in order from 1 to 20 until identifying an alternative pixel location that is deactivated, meaning that the alternative pixel would not be printed in the existing image data. For example, the controller 80 identifies the binary image data in pixel location 1, and if the binary data indicate that the pixel in location 1 is already activated, the controller proceeds to successive pixel locations 2 through 20 until finding the first deactivated pixel location. The processor 80 then changes the binary image data to activate the alternative pixel location corresponding to one of the other inkjets 208A-208D. FIG. 3B depicts another search pattern, which is a mirror-image of the search pattern of FIG. 3A reflected along the process direction axis P. Alternative embodiments can use a greater or lesser number of pixels in the search pattern, and the order of the search can vary from the examples of FIG. 3A and FIG. 3B. The search order can also be randomized over a range of pixels instead of following a predetermined search order.

Process 100 identifies overlap between the identified alternative pixel location and other activated pixel locations in the binary image data (block 124). For example, in FIG. 2B, the controller 80 activates a compensated pixel 216A in a previously deactivated pixel location in the binary image data to compensate for the missing pixel 212A. The compensated pixel 216A is adjacent to another printed pixel 218, and the controller 80 identifies an overlap region 219. The controller 80 subsequently adds the identified overlap to the overlap parameter value (block 128). In one embodiment, process 100 identifies a number of overlaps between the alternative pixel location and nearby pixels. For example, pixel 216A overlaps a single activated pixel 218, but another pixel location could overlap multiple nearby activated pixels. The number of overlaps are added to the overlap parameter value, and the overlap parameter value is compared to the total overlap threshold. In another embodiment, the value of overlap can vary based on the arrangement of activated pixels around the alternative pixel location. For example, in FIG. 2B, an activated pixel 217 is offset diagonally from the alternative pixel location 216A. In one embodiment, the pixels 216A and 217 overlap, but the degree of overlap is less than the overlapping region 219. In one configuration, the controller 80 increments the overlap parameter value by 1 to include a larger overlap between pixels 216A and 218, and by 0.5 to include the smaller overlap between pixels 216A and 217.

Process 100 deactivates, or resets, the next identified activated pixel for the inoperable inkjet (block 132). In the binary image data depicted in FIG. 2B, the controller 80 resets the binary image data values from a "1" to a "0" for each of the identified pixels 212A-212E. During printing, the controller 80 does not generate firing signals for the inoperable inkjet 206.

In process 100, the processing described in blocks 112-132 continues for additional pixels in the column of pixels 220 corresponding to the inoperable inkjet 206 while the overlap parameter value remains below the predetermined overlap threshold. If the overlap parameter value exceeds the predetermined threshold (block 116), then the process 100 identifies an activates pixels in both the first alternative pixel location described above and a second alternative pixel location in the binary image data to print a ink drops in both locations (block 136). The second alternative pixel location is selected an additional compensation pixel for the missing inkjet. For example, in FIG. 2A and FIG. 2B, the predetermined overlap threshold value is exceeded when alternative pixel 216A is selected to compensate for pixel 212A. The controller 80 subsequently identifies activated pixels 212B, 212C, and 212D in the column 220. The overlap threshold is exceeded for each of the activated pixels 212B-212D.

The controller 80 identifies an alternative location for pixel 212B using the search pattern depicted in FIG. 3A, but the controller 80 selects the second available pixel location in the search pattern in addition to the first available pixel location. For the pixel 212B, the first available pixel in the binary image data corresponds to pixel 216B using the search pattern of FIG. 3A, and the controller 80 activates the pixel 216B. Because the overlap threshold has been exceeded, the controller 80 continues the search and identifies pixel location 228A as the second available pixel location in the binary image data. The controller 80 sets the image data value to a "1" at the second pixel location 228A to activate the second pixel location. The controller 80 activates the primary alternative pixels 216C and 216D as well as the secondary alternative pixel locations 228B and 228C for pixels 212C and 212D, respectively, in a similar manner.

The activation of the second pixel location in addition to the first available pixel location increases the coverage area of compensated pixels in the image data. When degree of overlap in the compensated pixels is too high, the density of the printed image is less than the density of the original ink image because the overlapping ink drops cover a smaller total area of the image receiving surface than non-overlapping ink drops. For example, in FIG. 4A the non-overlapping ink drops 404 and 408 cover a larger area 412 of the image receiving surface 14 than the area 416 covered by the overlapping ink drops 224A and 224B in FIG. 4B. The reduced image density due to the overlapping ink drops accentuates image artifacts, such as light streaks, that are generated in half-tone ink images due to the inoperable inkjet. Process 100 compensates for overlap to generate ink images with image densities that more closely approximate the image density if the inoperable inkjet were functioning normally. Thus, process 100 increases the area of the printed image that is covered by ink and enables compensation for inoperable inkjets over a wider range of ink drop densities during printing.

Process 100 reduces the overlap parameter value of the pixel column corresponding to the inoperable inkjet when a pixel is assigned to a second location (block 140), and deactivates the identified pixel corresponding to the inoperable inkjet (block 132). In one embodiment, the controller 80 subtracts the predetermined overlap threshold value from the overlap parameter value after activating the pixel in the second location in the binary image data. In another embodiment, the controller 80 decrements the overlap parameter value by another predetermined amount.

Figure 2B:
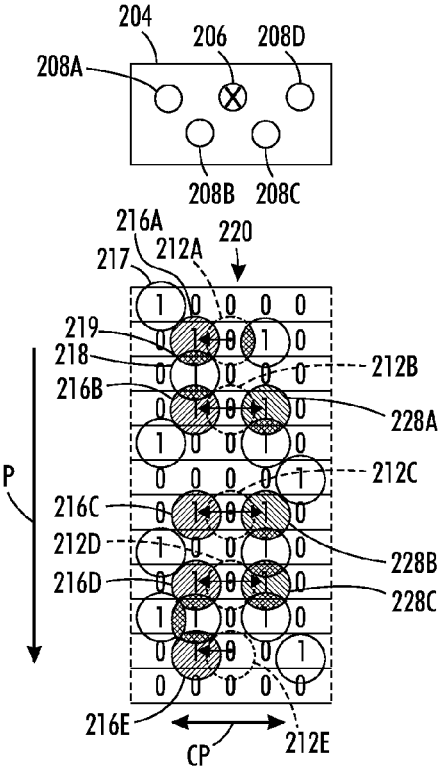
FIG. 2B is a schematic diagram of the printhead of FIG. 2A and an exemplary view of ink drops that are printed to compensate for the inoperable inkjet in the printhead.

Process 100 decreases the overlap parameter value so that process 100 can return to activating pixels in the first alternative location identified in the search pattern when the level of overlap in the binary image data decreases. In denser regions of the image data, process 100 activates a large portion of the compensating pixels in the secondary locations in the search pattern, which spreads the compensating pixels over a wider area. In another region of the image data having a lower density, the degree of overlap decreases and a greater proportion of the compensating pixels are activated in the first available location in the search pattern. Consequently, the process 100 adapts to variations in the density of printed pixels in the binary image data extending along the length of the pixel column 220. In the example of FIG. 2B, the controller 80 decreases the overlap parameter value below the overlap threshold prior to identifying activated pixel 212E, and the controller 80 activates the first available alternative pixel location 216E.

Process 100 continues to identify activated pixels in the column of image data that correspond to ink drops to be ejected by the inoperable inkjet, and to compensate for the pixels as described above. After compensating for each activated pixel in the column (block 112), process 100 continues to compensate for pixels corresponding to any additional inoperable inkjets in the printer (block 144). A multi-color printer, such as the printer 10 in FIG. 5, performs process 100 using binary image data for each color separation in the printer. For example, in the CMYK embodiment of printer 10, process 100 is performed to compensate for any inoperable inkjets in each of the cyan, magenta, yellow, and black colors. After modifying the image data to compensate for the inoperable inkjets, process 100 generates firing signals using the modified image data (block 148). In the printer 10, the controller 80 generates electrical firing signals for the inkjets in the printhead units 32 and 34. The modified binary image data includes deactivated pixels for the inoperable inkjets, and the controller 80 generates no firing signals for the inoperable inkjets. The controller 80 also generates firing signals for each of the activated alternative pixel locations to compensate for the inoperable inkjets.

It will be appreciated that various of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A method for printing pixels in an image comprising:

identifying a plurality of pixels in image data to be printed by an inoperable inkjet in a plurality of inkjets;

identifying a first location in the image data for storage of a compensation pixel corresponding to one of the plurality of pixels to be printed by the inoperable inkjet, the first location being identified with reference to a predetermined sequence of pixel locations positioned about the one pixel to be printed by the inoperable inkjet;

identifying an overlap parameter for ink to be ejected by the plurality of inkjets;

storing the compensation pixel in a second location in the image data in response to the overlap parameter exceeding a predetermined threshold, the second location being a position in the predetermined sequence that is beyond the first location; and resetting the one pixel to be printed by the inoperable inkjet.

2. The method of claim 1 further comprising:

storing another compensation pixel in the first location in the image data.

3. The method of claim 1 further comprising:

adjusting the overlap parameter in response to the compensation pixel being stored in the second location in the image data.

4. The method of claim 3 further comprising:

storing a compensation pixel in the identified second location for any pixel to be printed by the inoperable inkjet in response to the adjusted overlap parameter exceeding the predetermined threshold.

5. The method of claim 4 further comprising:

resetting the overlap parameter to an initial value;

identifying a plurality of pixels in image data to be printed by another inoperable inkjet in the plurality of inkjets;

identifying a first location in the image data for storage of a compensation pixel corresponding to one of the plurality of pixels to be printed by the other inoperable inkjet, the first location being identified with reference to a predetermined sequence of pixel locations positioned about the one pixel to be printed by the other inoperable inkjet;

identifying an overlap parameter for ink to be ejected by the plurality of inkjets;

storing the compensation pixel in a second location in the image data in response to the overlap parameter exceeding a predetermined threshold, the second location being a position in the predetermined sequence that is beyond the first location; and resetting the one pixel in the image data for the other inoperable inkjet.

6. The method of claim 5 further comprising:

adjusting the overlap parameter in response to the compensation pixel being stored in the second location in the image data.

7. The method of claim 6 further comprising:

identifying one of the first location and the second location for each pixel to be printed by the other inoperable inkjet;

storing a compensation pixel in the identified second location for any pixel to be printed by the other inoperable inkjet in response to the adjusted overlap parameter exceeding the predetermined threshold.

8. The method of claim 7 further comprising:

operating the plurality of inkjets with reference to the image data.

9. The method of claim 1, the second location in the image data being offset in a cross-process direction from the identified one of the plurality of pixels.

10. The method of claim 9, the second location in the image data being offset in the cross-process direction from the first location in the image data.

11. The method of claim 9 further comprising:

operating one of the plurality of inkjets that is offset in the cross-process direction from the inoperable inkjet with reference to the compensation pixel in the second location in the image data.

12. An inkjet printer comprising:

a plurality of operable inkjets and an inoperable inkjet, each one of the operable inkjets being configured to eject ink onto an image receiving surface; and a controller operatively connected to the plurality of inkjets and the inoperable inkjet, the controller being configured to:

identify a plurality of pixels in image data to be printed by the inoperable inkjet;

identify a first location in the image data for storage of a compensation pixel corresponding to one of the plurality of pixels to be printed by the inoperable inkjet, the first location being identified with reference to a predetermined sequence of pixel locations positioned about the one pixel to be printed by the inoperable inkjet;

identify an overlap parameter for ink to be ejected by the plurality of operable inkjets;

store the compensation pixel in a second location in the image data in response to the overlap parameter exceeding a predetermined threshold, the second location being a position in the predetermined sequence that is beyond the first location; and reset the one pixel to be printed by the inoperable inkjet.

13. The inkjet printer of claim 12, the controller being further configured to:

store another compensation pixel in the first location in the image data.

14. The inkjet printer of claim 12, the controller being further configured to:

adjust the overlap parameter in response to the compensation pixel being stored in the second location in the image data.

15. The inkjet printer of claim 14, the controller being further configured to:

identify one of the first location and the second location for each pixel to be printed by the inoperable inkjet; and store a compensation pixel in the identified second location for any pixel to be printed by the inoperable inkjet in response to the adjusted overlap parameter exceeding the predetermined threshold.

16. The inkjet printer of claim 15 further comprising:

another inoperable inkjet; and the controller being further configured to:

reset the overlap parameter to an initial value;

identify a plurality of pixels in image data to be printed by the other inoperable inkjet;

identify a first location in the image data for storage of a compensation pixel corresponding to one of the plurality of pixels to be printed by the other inoperable inkjet, the first location being identified with reference to a predetermined sequence of pixel locations positioned about the one pixel to be printed by the other inoperable inkjet;

identify an overlap parameter for ink to be ejected by the plurality of operable inkjets;

store the compensation pixel in a second location in the image data in response to the overlap parameter exceeding a predetermined threshold, the second location being a position in the predetermined sequence that is beyond the first location; and reset the one pixel in the image data for the other inoperable inkjet.

17. The inkjet printer of claim 16, the controller being further configured to:

adjust the overlap parameter in response to the compensation pixel being stored in the second location in the image data.

18. The inkjet printer of claim 15, the controller being further configured to:

identify one of the first location and the second location for each pixel to be printed by the other inoperable inkjet; and store a compensation pixel in the identified second location for any pixel to be printed by the other inoperable inkjet in response to the adjusted overlap parameter exceeding the predetermined threshold.

19. The inkjet printer of claim 18, the controller being further configured to:

operate the plurality of operable inkjets with reference to the image data.

20. The inkjet printer of claim 12, the second location in the image data being offset in a cross-process direction from the identified one of the plurality of pixels.

21. The inkjet printer of claim 20, the second location in the image data being offset in the cross-process direction from the first location in the image data.

22. The inkjet printer of claim 21 the controller being further configured to:

operate one of the plurality of operable inkjets that is offset in the cross-process direction from the inoperable inkjet with reference to the compensation pixel in the second location in the image data.

* * * * *